US006139476A

United States Patent [19]

Gallant

[11] Patent Number: 6,139,476

[45] Date of Patent: Oct. 31, 2000

[54] DYNAMIC TENSIONER FOR PHYSIOLOGICAL SCULPTING

[76] Inventor: Raymond J. Gallant, 485 Kawaihae St., Honolulu, Hi. 46825

[21] Appl. No.: 09/304,981

[22] Filed: May 4, 1999

Related U.S. Application Data

[60] Provisional application No. 60/084,270, May 5, 1998.

[51] Int. Cl.[7] ..... A63B 21/012; A63B 21/015; A61F 13/00

[52] U.S. Cl. ..... 482/114; 482/115; 482/118; 602/16

[58] Field of Search ..... 482/114, 115, 482/118, 119; 81/59.1, 58.4, 58.1; 192/44, 45; 403/148, 149, 145; 602/16

[56] References Cited

U.S. PATENT DOCUMENTS

| | | | |
|---|---|---|---|
| 2,543,729 | 2/1951 | Magida | 482/118 |
| 2,725,232 | 11/1955 | Magida | 482/118 |
| 2,819,081 | 1/1958 | Touraine . | |
| 2,832,334 | 4/1958 | Whitelaw | 482/118 X |
| 2,972,271 | 2/1961 | Gill | 81/480 |
| 3,704,886 | 12/1972 | Kay et al. . | |
| 4,051,560 | 10/1977 | Audet . | |
| 4,374,588 | 2/1983 | Ruggles | 482/118 |
| 4,465,276 | 8/1984 | Cox | 482/126 |
| 4,611,807 | 9/1986 | Castillo . | |
| 4,762,031 | 8/1988 | Bradley | 81/57.22 |
| 4,987,803 | 1/1991 | Chern | 81/57.39 |
| 5,052,379 | 10/1991 | Airy et al. | 602/16 |
| 5,328,446 | 7/1994 | Bunnell et al. | 602/16 |
| 5,557,994 | 9/1996 | Nakayama | 81/478 |
| 5,788,618 | 8/1998 | Joutras | 482/114 |

*Primary Examiner*—John Mulcahy
*Assistant Examiner*—Denise Pothier
*Attorney, Agent, or Firm*—Siemens Patent Services LC

[57] ABSTRACT

A dynamic tensioner that exhibits direction responsive, adjustable, rotational resistance. The tensioner is particularly suited for use in exercise equipment to provide physiological sculpting. A ratcheting mechanism is combined with an adjustable resistance bearing to provide a specific resistance in a first rotational direction, and almost no resistance in the opposite rotational direction, based on the position of a selector switch. Two of the tensioners can be used to provide adjustable resistance in both rotational directions. When two of the tensioners are used, the ratcheting mechanisms can be set to work oppositely to allow adjustable resistance in both directions, or set to work together for increased adjustable resistance in one direction and free movement in the opposite direction. Various embodiments of the adjustable resistance bearing are envisioned. An exercise bar and an exercising leg or arm brace, using the dynamic tensioner of the present invention are also disclosed.

5 Claims, 3 Drawing Sheets

DYNAMIC TENSIONER FOR PHYSIOLOGICAL SCULPTING

CROSS REFERENCE TO RELATED APPLICATIONS

This application is related to U.S. Provisional Patent Application No. 60/084,270, filed May 5, 1998.

BACKGROUND OF THE INVENTION

1. FIELD OF THE INVENTION

The present invention relates generally to rotational resistance devices. More specifically, the invention comprises a rotational exercise device that provides different levels of adjustable rotational resistance depending on the direction of rotation. The device includes a ratchet to minimize the torque required to rotate the device in a first direction, and an axially loaded bearing to adjust the torque required to rotate the device in the opposite direction. Two ratchets or two devices can be used to provide adjustable resistance in both directions of rotation.

2. DESCRIPTION OF THE PRIOR ART

Many different types of rotational exercise devices have been designed in the past. Most of these exercisers include means to adjust the rotational resistance in one or both directions. What is lacking in the prior art, is a rotational exercise device that can be adjusted to provide smooth resistance in one direction, while providing a smooth lower resistance in the opposite direction. This allows specific muscle conditioning for any limb of the body. Thus the present invention is particularly suited for physiological sculpting.

U.S. Pat. No. 2,819,081, issued to Touraine on Jan. 7, 1958, discloses exercisers. The exercisers include an inner and an outer metal ring. The outer ring is attached to a platform, while the inner ring fits firmly within the outer ring. Set screws hold the inner ring inside the outer ring and provide frictional forces when the inner ring is rotated with respect to the outer ring. The exerciser is used to exercise the shoulder, elbow, wrist and fingers. There is no provision to provide different levels of rotational resistance depending on the direction of rotation.

An exercise machine with spring-return pedals and pull lines is detailed in U.S. Pat. No. 3,704,886, issued to Kay et al. on Dec. 5, 1972. The machine has a pair of movable pedals and handles attached to lines wound upon sheathes mounted within the machine. Adjustment mechanisms are disclosed to adjust the amount of force required to pull the handles or push the pedals, with the non-frictional return of the handles or pedals being facilitated using springs. In this manner, this machine allows adjustable rotational resistance in a first direction with reduced resistance in the opposite direction. In contrast to the present invention, this machine uses a complex cable and pulley arrangement with an adjustable brake. The resulting action is not as smooth as the tensioner of the present invention, nor is it possible to easily reverse the direction of increased rotational resistance.

U.S. Pat. No. 4,051,560, issued to Audet on Oct. 4, 1977, is drawn to a bowel movement energizer system. The system comprises two clamp-on rotational resistance devices for initiating a bowel movement by exercising one's arms while sitting on a toilet. Resistance is provided by friction between a wheel and a pad in an axially loaded embodiment and between the wheel and a rotation resistant idler wheel in a radially loaded embodiment. Both embodiments include resistance adjustment means, however, there is no disclosure of providing different levels of rotational resistance in opposite directions.

Another exercise apparatus is disclosed in U.S. Pat. No. 4,611,807, issued to Castillo on September 1986. This apparatus includes a pair of adjustable spaced apart, rotating discs mounted on a frame. A radially loaded, wheel provides adjustable, rotational resistance for each disc. Each disc also has a handle for a user to grasp when exercising their upper body. The wheels are incapable of providing a different level of rotational resistance when the disc is turned in the opposite direction. In addition, this type of adjustable loading results in uneven loading of the disc, and therefore uneven rotational resistance at different points in the rotation.

None of the above inventions and patents, taken either singly or in combination, is seen to describe the instant invention as claimed.

SUMMARY OF THE INVENTION

The present invention is a dynamic tensioner specifically designed for use in exercise equipment. A ratcheting mechanism is combined with an adjustable resistance bearing to provide a specific resistance in a first rotational direction, and almost no resistance in the opposite rotational direction. Two of the tensioners can be used to provide adjustable resistance in both rotational directions. When two of the tensioners are used, the ratcheting mechanisms can be set to work oppositely to allow adjustable resistance in both directions, or set to work together for increased adjustable resistance in one direction and free movement in the opposite direction.

The ratcheting mechanisms used in the present invention are all of the conventional type, similar to those used in ratchet drivers for socket tools. A selector in the form of a movable disc or switch on one side of the rachet head can be spun or flipped between two ratcheting positions (one position for allowing ratcheting action in a first rotational direction and a second position for allowing ratcheting action in the opposite direction). In some of these ratchets, a central locking position is provided between the two ratcheting positions to lock the handle to the central shaft of the ratchet. The central shaft of the ratchet used in the present invention includes external male threads for accepting a nut thereon. The nut (which can be replaced with a locking lever as explained below) holds the various components of the adjustable resistance bearing on the shaft, while providing the adjustment mechanism for the bearing as well.

Various embodiments of the adjustable resistance bearing are envisioned. These embodiments vary in the amount of resistance they can impart, as well as the amount of force and length of use they can endure. In the simplest embodiment, each half of the bearing is comprised of two plates that are pressed against each other (using the nut) to provide a high degree of friction. The plates can be made of several different materials to provide greater or less friction, decreased wear, etc. A second embodiment of the bearing includes two thrust bearings with a plurality of radially aligned roller bearings mounted between two metal plates. As with the first embodiment, the two plates are pressed against each other to adjust the level of friction. The thrust bearing provides friction in a lower range than the two simple plates, can handle higher forces, and increases the useful life of the bearing by reducing wear. In addition to these features, the thrust bearing eliminates the "slip and stick" phenomena associated with simple bearings. This is the nature of a simple bearing wherein once the static friction is overcome, the dynamic friction is at a lower level, causing jerky movement as one surface is rotated relative to the other.

For even heavier applications one or both of the thrust bearings are replaced with a conical roller bearing. The conical roller bearing is extremely heavy duty and has a very long lifetime. As with the other bearings, axial compression using a threaded nut or lever is used to adjust the rotational friction of the bearing (to a lesser extent). The conical bearing also helps to absorb any lateral forces applied to the bearing. As is known in the bearing art, the conical bearing is comprised of an inner conical race, an outer conical race, a plurality of cylindrical rollers and a roller cage for maintaining the relationship between the rollers.

There are a myriad of different exercising devices and machines that could benefit from the advantages of the dynamic tensioner of the present invention. Two such exercise devices are described herein. A first exerciser is a simple articulated bar type exercise device wherein a user holds both ends of the bar, and bends the bar about a central rotational resistive bearing, bringing the ends close to one another. The user then pulls the ends of the bar apart, to return the ends to their original position (some of these type devices include spring means to return the bar to its straight configuration). This action is then repeated using various positions to exercise the arms, wrists, shoulders and upper body. The dynamic tensioner of the present invention increases the usefulness of this type device when used as the central bearing. The bar exerciser can be adjusted such that in a first direction (the bar can be bent in either direction) the exerciser exhibits an adjustable rotational resistance, and in the second direction the ratchet allows almost frictionless movement. Handles are provided on the ends of the bar for a firm grip.

A second exercise device using the present invention is in the form of a leg or arm brace. A first cuff is designed to be placed around the upper part of an arm or leg. A second cuff is designed to be placed around the lower part of the arm or leg below the elbow or knee, respectively. The two cuffs are rotatable attached to each other using two hinges, one on each side. A first dynamic tensioner is used as the hinge pin on one of the hinges and a second dynamic tensioner is used as the hinge pin on the other hinge. The dynamic tensioner on one side can be set to provide rotational resistance in a first direction (either bending or straightening the arm or leg), and the dynamic tensioner on the other side can be set to provide rotational resistance in the opposite direction. The adjustment nut or lever faces the outside of the brace for ease in adjustment.

While two examples of exercising equipment have been discussed that use the dynamic tensioner of the present invention, it should be realized that the dynamic tensioner could find application anywhere a direction specific, rotational resistant bearing is desired. The dynamic tensioner can be used individually to provide adjustable, rotational resistance in only one direction, or in pairs to provide adjustable, rotational resistance in both directions.

Accordingly, it is a principal object of the invention to provide a dynamic tensioner that exhibits adjustable rotational resistance in a first direction of rotation, and exhibits minimal rotational resistance in the opposite direction of rotation.

It is another object of the invention to provide a dynamic tensioner that exhibits a first adjustable rotational resistance in a first direction of rotation, and exhibits a second adjustable rotational resistance in the opposite direction of rotation.

It is a further object of the invention to provide an exercising bar with a central bearing in the form of a dynamic tensioner that exhibits adjustable rotational resistance in a first direction of bending or straightening the bar, and exhibits minimal rotational resistance in the opposite direction.

It is yet another object of the invention to provide an exercising leg or arm brace with a dynamic tensioner that exhibits a first adjustable rotational resistance in a first direction of rotation, and exhibits a second adjustable rotational resistance in the opposite direction of rotation.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
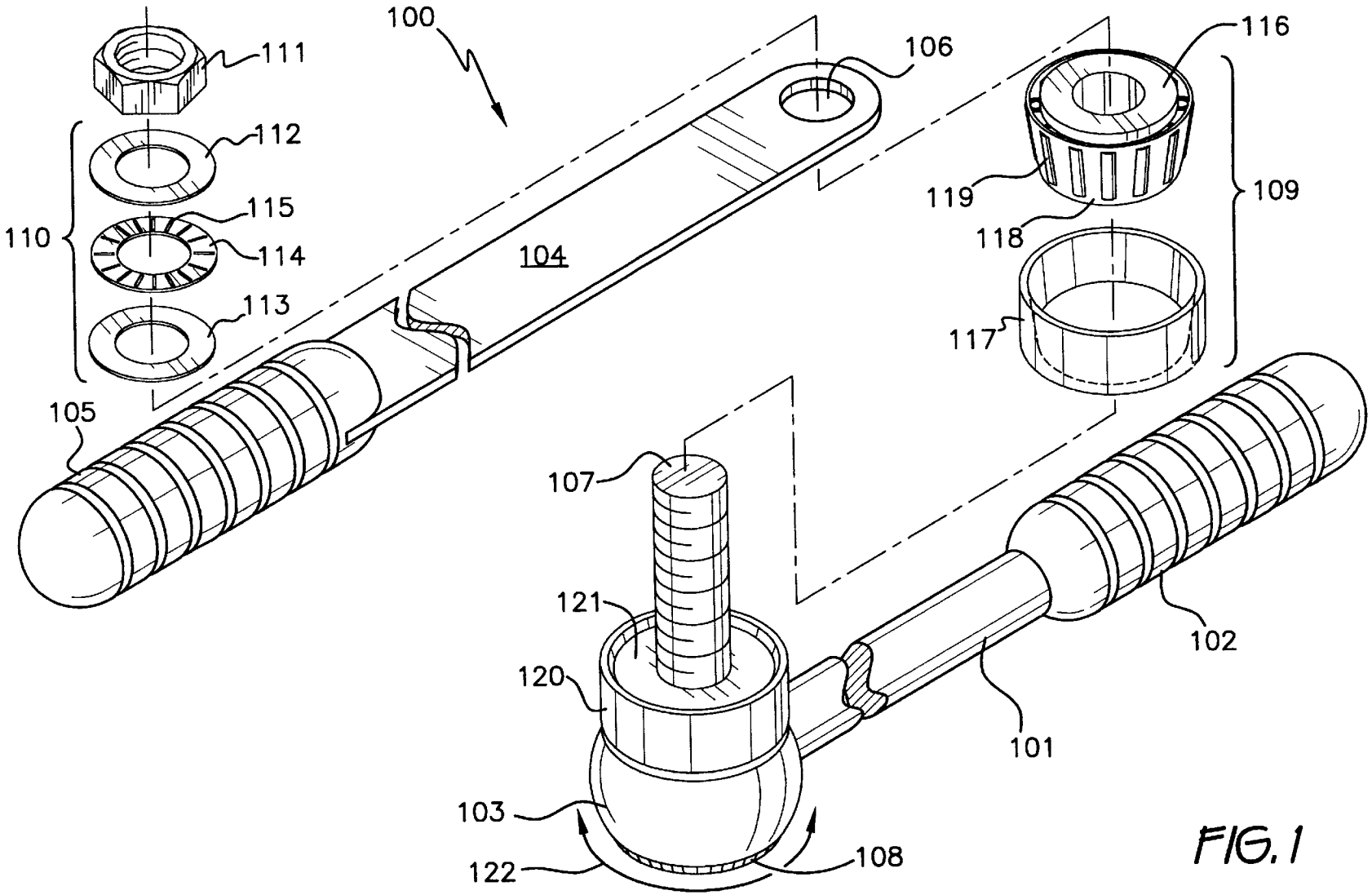
FIG. 1 is an exploded isometric view showing the various components of the dynamic tensioner of the present invention.
Figure 2:
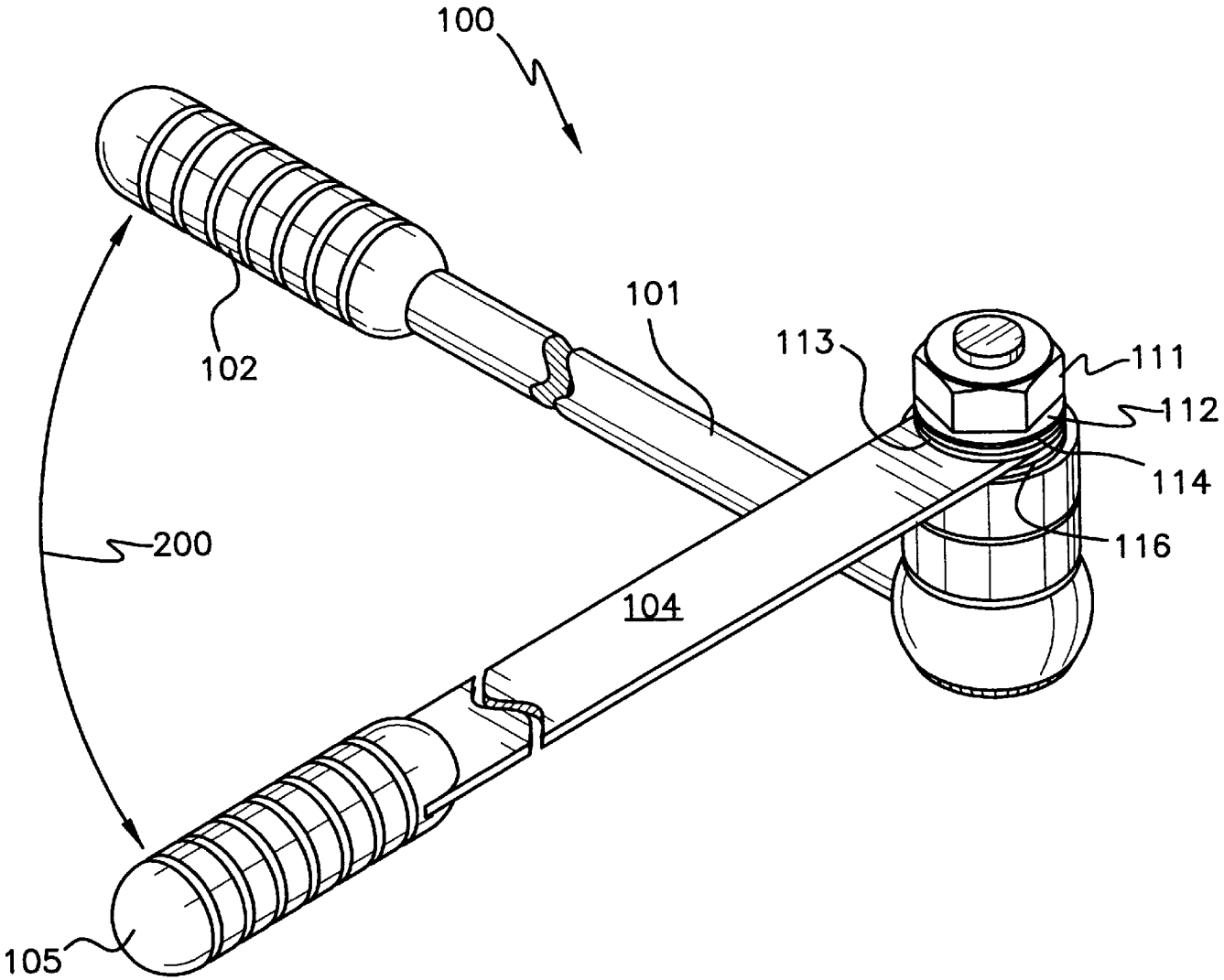
FIG. 2 is a top plan view of the exercise bar of FIG. 1, showing the various relative positions between the crank arm handle and the ratchet handle.

In FIGS. 1 and 2, the dynamic tensioner of the present invention is shown configured for use as the central bearing in an exercising bar 100. The dynamic tensioner includes a conventional ratchet similar to those used in socket sets. For use in the exercise bar 100, the ratchet body 101 includes a handle 102 to provide a firm hand grip at a first end of the exercising bar 100. The second end of the exercise bar 100 is formed by a crank arm 104 that includes a second handle 105 for gripping the exercise bar 100 at the second end. The crank arm 104, ratchet body 101 (including the internal ratchet itself), and the adjustable resistance bearing that connects them, make up the dynamic tensioner of the present invention (keeping in mind that the shape and length of the crank arm and the ratchet body can be configured for use in various applications, the exercise bar 100 having handles at the ends being only one such application).

Ratchet body 101 includes a ratchet head 103 at the end opposite handle 102. Extending from the top of the ratchet head 103 is a threaded shaft 107 (in place of the conventional socket driving shaft normally associated with a ratchet driver). Within the ratchet head 103 is a ratchet assembly as is well known in the ratchet driver art. A selector in the form of a rotating disc 108 is shown mounted on the bottom of the ratchet head 103. Disc 108 can be rotated (as shown by line 122 in FIG. 1) between two positions, in a first position, the ratchet permits free rotation between the shaft 107 and the ratchet head 103 in a first rotational direction and is locked in a second, opposite direction, and when the disc 108 is in the second position, the ratchet permits free rotation in the a second direction and is locked in the first direction. To provide the ability to create equal, adjustable, rotational resistance in both directions, a ratchet having a selector with a central locking position can be used. In the central position, the shaft 107 and ratchet head 103 are locked together. As the ratchet otherwise operates as is well known in the art, no further discussion thereof is deemed necessary.

The adjustable, rotationally resistive bearing of the dynamic tensioner of the present invention is shown in its most complex and strongest embodiment in FIG. 1. All of the components of the simpler embodiments of the bearing are also shown. Shaft 107 has a first bearing 109 (shown here as a conical roller bearing) installed closest to the ratchet head 103. Shaft 107 then extends through a hole 106, that is provided at the end of crank arm 104 opposite handle 105. A second bearing 110 (shown here as a thrust bearing) is then placed on shaft 107. An internally threaded nut 111 is then threaded on shaft 107 to hold the assembly together. In addition to holding the components together, nut 111 is used to adjust the friction exhibited by the bearings by axially loading the bearings when tightened on shaft 107. While nut 111 is shown as a standard hex nut, it may be replaced by a locking lever assembly as found on quick release bicycle wheels. These locking levers can be tightened or loosened on shaft 107, and can then be "locked-down" to a desired holding position and tightness.

The thrust bearing shown in use as the upper bearing 110 in FIG. 1, is used in applications having medium force loads and medium friction requirements. Thrust bearing 110 includes a top plate 112, a bottom plate 113 and a bearing cage 114. Bearing cage 114 has a plurality of radially aligned, cylindrical roller bearings 115 mounted therein. The thrust bearing has a major advantage over simple plate to plate bearings, in that the rollers eliminate the stick-and-slip phenomena as described previously. The materials used to make up the plates 112 and 113, the cage 114 and the roller bearings 115 can be selected to provide the desired friction to axial force characteristics. For example, should relatively low friction be desired, stainless steel components are used. To increase the friction the roller bearings are made of urethane or other elastomeric materials that can be compressed out-of-round to increase the friction exerted by the bearing. Should even greater frictional forces be desired, the cage 114 and the roller bearings 115 can be omitted such that, top plate 112 and bottom plate 113 form a simple two plate bearing.

In extremely heavy duty applications where large lateral forces may be encountered, a conical roller bearing is used as the bottom bearing 109, as shown in FIG. 1. The conical roller bearing 109 includes an inner conical bearing race 116 and an outer conical bearing race 117. A plurality of cylindrical rollers 119 are mounted between the inner conical bearing race 116 and the outer conical bearing race 117. Roller cage 118 holds the roller 119 and maintains the conical configuration of the rollers 119, as is well known in the bearing art. When nut 111 is tightened, the inner 116 and the outer 117 races are forced together, thereby increasing friction exerted by the bearing 109. As with the thrust bearing 110, different materials may be used for the rollers and races to vary the axial force to friction ratio. With some conical bearings, the bottom of the rollers 119 and part of the cage 118, may extend below the outer conical bearing race 117. To avoid having these components rub against the head 103 of the ratchet, a lower guide 120 may be provided with a central recess 121 which the lower portions of the rollers 119 and the cage 118 occupy.

Many different types of bearings may be used as the top 110 and bottom 109 bearings in the dynamic tensioner of the present invention. The only overall requirement of the bearings is that they can be axially loaded to increase rotational friction. In most applications, a simple two plate (shown as 112 and 113 in FIG. 1) bearing is used to minimize the size of the tensioner 100, and to provide a relatively high level of rotational resistance for exercising.

To use the exercise bar 100 in FIG. 1, a user first adjusts nut 111 (or the locking lever described above) to the desired level of resistance. The user then grasps the exercise bar by the handles 102 and 105, with one in each hand. The handles are then rotated about the central bearing, to first bring the handles toward one another, and to then pull them away from each other (shown by line 200 in FIG. 2). This is repeated to exercise the user's hands, wrists, arms and upper body. Due to the ratchet, the rotational resistance is greater in one direction then the other, as described above. This provides a method to target certain muscle groups. For example, should the resistance be greater when bringing the handles together, the pectoral and triceps muscles are primarily exercised and when the resistance is greater pulling the handles apart, the latisimus and biceps are targeted. To reverse the direction of greater resistance, the selector 108 on the ratchet may be switched to the opposite position, or the exercise bar can simply be flipped-over (such that nut 111 is facing downward in FIG. 2 without exchanging the handles from one hand to the other). The flip-over technique may even be used in mid exercise to provide another variation in the exercise routine.

Figure 3:
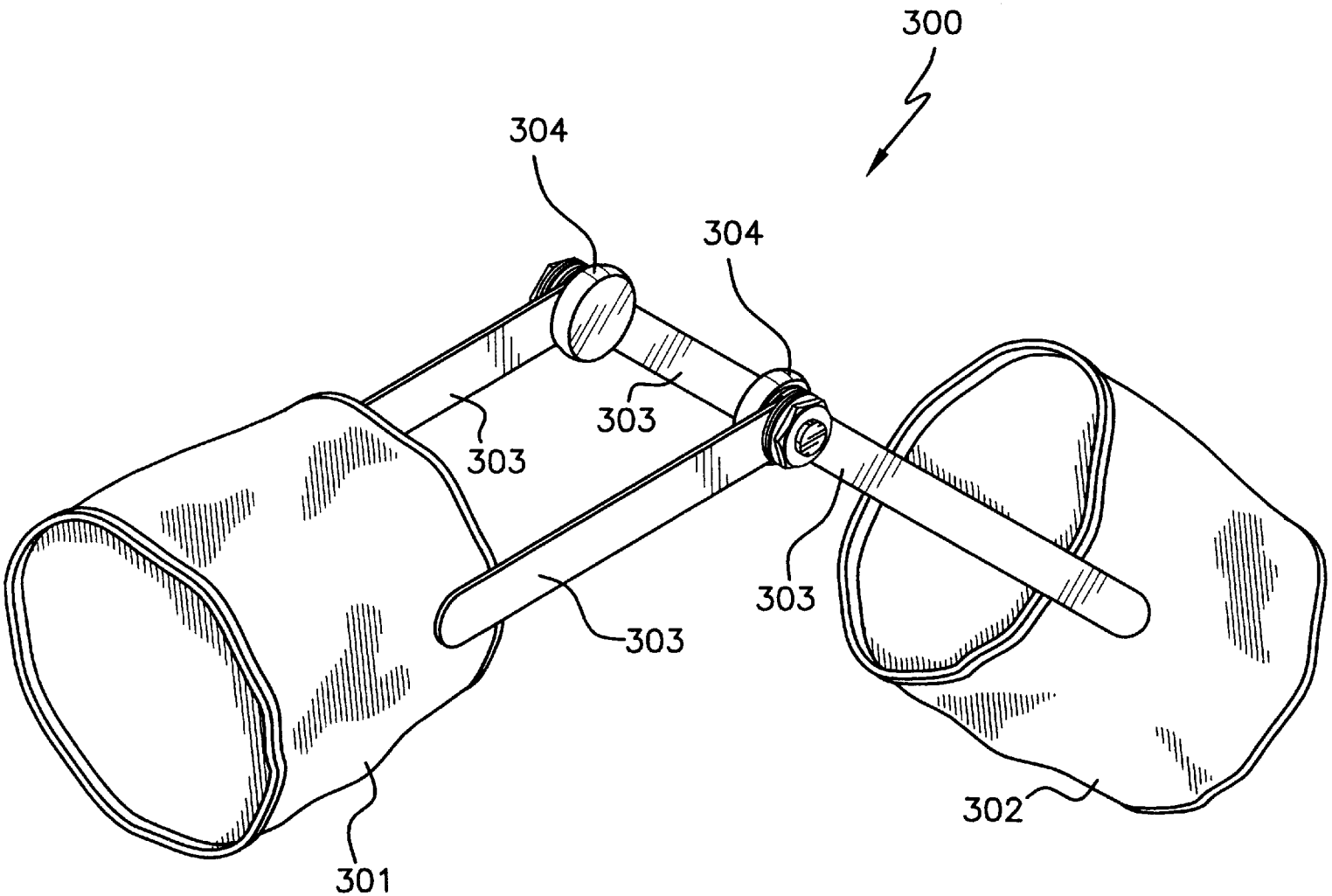
FIG. 3 is a top plan view of an exercising brace using two of the dynamic tensioners of the present invention.

In FIG. 3, an exercising brace 300 for an elbow or knee is shown. A first cuff 301 is placed about a user's upper arm or leg, while a second cuff 302 is placed about the lower portion of the same limb. The cuffs 301 and 302 are rotationally connected to each other by two pairs of rods 303 (one pair on each side) and two dynamic tensioners 304 (one on each side). In prior art braces, the rods 303 are usually connected by a simple pivot pin, such as a rivet. The rods 303 are connected to the cuffs 301 and 302, either by providing a pocket in the cuffs for accepting the rods 303, providing apertures in the rods 303 for sewing the rods 303 to the cuffs, or any suitable method known in the leg and arm brace art. The actual shape of the rods 303 is not of import as long as the ends of the rods not attached to the cuffs are suitably shaped to: 1) act as crank arm 104 (having a hole 106 for mounting on shaft 107); and 2) support the ratchet head 103.

The dynamic tensioners 304 are mounted to the cuffs 301 and 302 such that by flexing their limb, the wearer of the brace 300 rotates the crank arms of the dynamic tensioners in a first direction relative to the ratchet heads of the dynamic tensioners, and by extending their limb the wearer rotates the crank arms in a second opposite direction relative to the ratchet heads. The selectors on the ratchet heads are preferably mounted such that they can easily be moved between positions while the brace 300 is worn. The adjustment nuts or levers are mounted outwardly to allow access to changing the rotational resistance of the bearing.

In use, a person, (either the wearer or a health professional) adjusts the desired resistance for each bearing, and selects the desired rotational resistance direction for each ratchet. Using the arm as an example, should the biceps be targeted, both selectors are set such that rotational resistance is encountered on the flexing stroke. If triceps are to be exercised, the selectors are both set to the opposite position to provide rotational resistance on the extending stroke. Due to the versatility of the present invention, the selectors can further be set in opposite positions to tune the rotational resistance ratio for true physiological sculpting.

There are a myriad of exercising machines, braces and other devices that use rotational resistance in one form or another and can benefit from the versatility of the dynamic tensioner of the present invention. It should be understood that the main thrust of the present invention is to provide a dynamic tensioner that exhibits direction responsive, adjustable, rotational resistance.

It is to be understood that the present invention is not limited to the embodiments described above, but encompasses any and all embodiments within the scope of the following claims.

I claim:

1. A dynamic tensioner exercise bar for providing directionally responsive, adjustable rotational resistance, said exercise bar comprising:

a crank arm having first and second crank arm ends and a first handle at the first crank arm end;

a ratchet body having first and second ratchet body ends, the first ratchet body end including a head portion, a ratchet within said head portion, a shaft extending from said head portion, and a selector, said selector being adjustable to select the rotational direction in which the ratchet prohibits free movement of said shaft relative to the ratchet head, said ratchet body having a second handle on the second ratchet body end, an adjustable rotational resistance bearing rotatably connected to the second crank arm end and the shaft, the adjustable rotational resistance bearing comprising:

a bearing assembly on said shaft and means for applying an adjustable axial force on said bearing assembly to provide a selected level of friction to said bearing assembly;

whereby the user encounters rotational resistance when the user moves said first handle relative to said second handle in one rotational direction and the user encounters free rotational movement when the user moves said first handle relative to said second handle in an opposite rotational direction, the direction of the free movement is determined by said selector.

2. The dynamic tensioner according to claim 1, wherein said bearing assembly comprises:

a first plate mounted on said shaft;

a second plate mounted on said shaft adjacent said first plate; and said means for apply an adjustable axial force to urge said plates together to produce a selected level of friction that results in the predetermined force being required to rotate said crank arm relative to said shaft.

3. The dynamic tensioner according to claim 1, wherein said bearing assembly is a thrust bearing, said thrust bearing comprising:

a first plate mounted on said shaft;

a second plate mounted on said shaft; and a first bearing cage mounted on said shaft between said plates, said first bearing cage including a first plurality of radially aligned, cylindrical roller bearings mounted therein for rolling engagement with said plates; and said means for applying an adjustable axial force to urge said plates together thereby applying force to said first plurality of radially aligned, cylindrical roller bearings to produce a selected level of friction that results in the predetermined force being required to rotate said crank arm relative to said shaft.

4. The dynamic tensioner according to claim 3, wherein said bearing assembly further comprises:

an inner conical bearing race mounted on said shaft;

an outer conical bearing race mounted on said shaft; and a conical bearing cage mounted on said shaft between said inner and outer races, said conical bearing cage including a second plurality of conically aligned, cylindrical roller bearings mounted therein for rolling engagement with said inner and outer races; wherein said first plate, said second plate and said first bearing cage are mounted between said means to apply an adjustable axial force and said crank arm;

said inner conical bearing race, said outer conical bearing race and said conical bearing cage are mounted between said crank arm and said ratchet head; and said means to apply an adjustable axial force urges said first and second plates together and said inner and outer races together to produce the selected level of friction.

5. An exercising brace for attachment to a user's limb for exercising the limb, said brace exercising brace comprising a first cuff, a second cuff and a first and second dynamic tensioner connecting the first cuff to the second cuff, said first and second dynamic tensioner each comprising:

a crank arm having first and second crank arm ends, said first cuff connected to the first crank arm end;

a ratchet body having first and second ratchet body ends, the first ratchet body end including a head portion, a ratchet within said head portion, a shaft extending from said head portion, and a selector, said selector being adjustable to select the rotational direction in which the ratchet prohibits free movement of said shaft relative to the ratchet head, said second cuff connected to the second ratchet body end, an adjustable rotational resistance bearing rotatably connected to the second crank arm end and the shaft, the adjustable rotational resistance bearing comprising:

a bearing assembly on said shaft and means for applying an adjustable axial force on said bearing assembly to provide a selected level of friction to said bearing assembly;

whereby the user encounters rotational resistance when the user moves said first cuff relative to said second cuff in one rotational direction and the user encounters free rotational movement when the user moves said first cuff relative to said second cuff in an opposite rotational direction, the direction of the free movement is determined by said selector.

* * * * *